US012790774B2

(12) United States Patent
Crocker

(10) Patent No.: US 12,790,774 B2
(45) Date of Patent: Nov. 10, 2026

(54) EPOXY TRUCK WITH LATERALLY DISPOSED HEATING KETTLES AND SURFACE APPLICATOR SYSTEM

(71) Applicant: FEDERAL SIGNAL CORPORATION, Downers Grove, IL (US)

(72) Inventor: James P. Crocker, Stuart, FL (US)

(73) Assignee: Federal Signal Corporation, Downers Grove, IL (US)

( * ) Notice: Subject to any disclaimer, the term of this patent is extended or adjusted under 35 U.S.C. 154(b) by 474 days.

(21) Appl. No.: 18/482,546

(22) Filed: Oct. 6, 2023

(65) Prior Publication Data

US 2024/0117576 A1 Apr. 11, 2024

Related U.S. Application Data

(60) Provisional application No. 63/378,786, filed on Oct. 7, 2022.

(51) Int. Cl.

| | |
|---|---|
| ***E01C 23/22*** | (2006.01) |
| ***E01F 9/518*** | (2016.01) |
| ***E01F 9/524*** | (2016.01) |

(52) U.S. Cl.

CPC ..... *E01C 23/22* (2013.01); *E01F 9/518* (2016.02); *E01F 9/524* (2016.02)

(58) Field of Classification Search

USPC ..... 118/58

See application file for complete search history.

(56) References Cited

U.S. PATENT DOCUMENTS

| | | | | |
|---|---|---|---|---|
| 1,940,964 A | | 12/1933 | McIntyre | |
| 2,076,172 A | * | 4/1937 | Bowden | E01C 23/22 118/305 |
| 2,518,952 A | * | 8/1950 | Sohmer | E01C 23/22 239/165 |
| 2,548,177 A | | 4/1951 | Tauber | |
| 2,607,337 A | | 8/1952 | Miller | |
| 3,554,449 A | | 1/1971 | Currie | |
| 3,682,054 A | | 8/1972 | MacPhail et al. | |
| 3,966,508 A | | 6/1976 | Mohr | |
| 4,196,854 A | * | 4/1980 | Prucyk | E01C 23/22 239/129 |

(Continued)

FOREIGN PATENT DOCUMENTS

| | | |
|---|---|---|
| DE | 19750359 | 6/1999 |
| EP | 0225653 | 6/1987 |

(Continued)

*Primary Examiner* — Jethro M. Pence

(74) *Attorney, Agent, or Firm* — Merchant & Gould P.C.

(57) ABSTRACT

A surface marking truck for heating and applying epoxy. The surface marking truck is self-propelled and comprised of laterally disposed kettles allowing for a platform area about the kettles for placement of replaceable totes holding epoxy, catalyst, or glass beads. Each tote is coupled to a kettle allowing gravity filling of each kettle. Epoxy and catalyst material held in the kettles and totes is heated before mixing and application through a spraying system. The spraying system includes a recirculation system that eliminates the need for jacketed transfer lines. Retro-reflective glass beads can be added to the epoxy during or after the spraying step.

8 Claims, 12 Drawing Sheets

(56) References Cited

U.S. PATENT DOCUMENTS

| | | | | |
|---|---|---|---|---|
| 4,247,045 | A | 1/1981 | Mitchell et al. | |
| 4,373,670 | A * | 2/1983 | Kilner | E01C 23/20 404/93 |
| 4,576,122 | A * | 3/1986 | Marcato | E01C 23/22 122/26 |
| 4,850,425 | A | 7/1989 | Anderson | |
| 4,872,419 | A * | 10/1989 | Blankemeyer | B05B 16/00 118/425 |
| 5,126,173 | A | 6/1992 | Machenaud | |
| 5,947,637 | A * | 9/1999 | Neuling | E01C 23/22 404/94 |
| 6,102,304 | A | 8/2000 | Gonitzke et al. | |
| 6,175,101 | B1 | 1/2001 | Miller et al. | |
| 6,439,473 | B1 * | 8/2002 | Meyer | G01G 19/38 239/69 |
| 7,626,143 | B2 | 12/2009 | Miller | |
| 8,201,717 | B2 | 6/2012 | Varga et al. | |
| 8,291,897 | B2 | 10/2012 | Shea | |
| 10,113,277 | B2 * | 10/2018 | Charnenka | B05B 9/06 |
| 10,301,783 | B2 * | 5/2019 | Dolinar | E01C 23/163 |
| 10,883,232 | B2 | 1/2021 | Crocker | |
| 11,054,538 | B1 * | 7/2021 | MacVittie | E01F 9/576 |
| 11,192,130 | B2 | 12/2021 | Crocker | |
| 11,261,571 | B2 * | 3/2022 | Dolinar | E01C 23/22 |
| 11,640,008 | B2 * | 5/2023 | MacVittie | E01C 23/163 324/323 |
| 12,066,553 | B2 * | 8/2024 | Macvittie | E01C 23/07 |
| 2004/0009212 | A1 | 1/2004 | Tsai | |
| 2011/0081134 | A1 | 4/2011 | Salyer | |
| 2012/0203475 | A1 | 8/2012 | Wilkens et al. | |
| 2013/0011193 | A1 * | 1/2013 | Price | E01F 9/506 404/94 |
| 2016/0032542 | A1 | 2/2016 | Crocker | |
| 2018/0142427 | A1 * | 5/2018 | Tkachenko | B60Q 1/543 |
| 2018/0347123 | A1 * | 12/2018 | Hoffmann | B65G 37/00 |
| 2023/0279622 | A1 * | 9/2023 | Whitaker | B05C 5/00 118/323 |
| 2023/0407581 | A1 * | 12/2023 | Crocker | E01F 9/518 |
| 2024/0159001 | A1 * | 5/2024 | Crocker | B05C 5/02 |
| 2024/0384479 | A1 * | 11/2024 | Wilkens | E01C 23/185 |

FOREIGN PATENT DOCUMENTS

| | | |
|---|---|---|
| GB | 2087958 | 6/1982 |
| KR | 101509321 | 2/2015 |
| WO | WO13063297 | 5/2013 |

* cited by examiner

DETAIL B

SECTION A-A

EPOXY TRUCK WITH LATERALLY DISPOSED HEATING KETTLES AND SURFACE APPLICATOR SYSTEM

PRIORITY CLAIM

In accordance with 37 C.F.R. 1.76, a claim of priority is included in an Application Data Sheet filed concurrently herewith. Accordingly, this application claims priority to U.S. Provisional Patent Application 63/378,786 entitled: EPOXY TRUCK WITH LATERALLY DISPOSED HEATING KETTLES AND SURFACE APPLICATOR SYSTEM, filed Oct. 7, 2022; the contents of which are incorporated herein by reference.

FIELD OF THE INVENTION

This invention relates generally to the field of road surface marking; and in particular, to truck mounted laterally disposed kettles and an applicator system for applying epoxy, paint, or polyurea to a road surface.

BACKGROUND OF THE INVENTION

Road surface markings vary in form: surface level permanently affixed, surface level temporarily but not permanently affixed, higher than road surface markers, and/or mechanical devices. They are designed to inform motorists and pedestrians as to proper positioning for safe travel. Designs range from merely a daytime or nighttime visual presentation to a raised pavement marker that advises motorists by light reflection or vehicle vibration resulting from contact between the vehicles tires and the raised marker. Efforts to improve road marking systems exist in the realm of the application of such markings, adding retro-reflectivity, increasing longevity, and lowering installation cost.

More specifically, two distinctions exist for road surface markings: mechanical and non-mechanical markings. Mechanical devices may be raised or recessed into the road surface, and either reflective or non-reflective. Most mechanical road surface markings are permanent; however, some are movable. Mechanical devices include, but are not limited to Botts' dots, rumble strips, and reflective markers.

Non-mechanical markings include, but are not limited to, polyurea, epoxy, tape, and thermoplastic pavement markings. For ease of description, epoxy will be used throughout this specification with the knowledge that paint, polyurea and various thermoplastics can be substituted with minimal equipment modification. An epoxy conventionally consists of a resin and a catalyst. The epoxy may also include additives such as retro-reflective glass beads and is generally used to mark travel lanes, spaces in parking lots or special purpose spaces for disabled parking, loading zones, or time-restricted parking areas. Epoxy is relatively low-cost compared to thermo-plastic applications, wherein epoxy requires heat sufficient to address viscosity and the application is based upon a two part admixture. Using epoxy a road is marked by a truck commonly called a "striper." Conventional striper trucks contain hundreds of gallons of epoxy material stored in vertically orientated containers mounted to the bed of the truck. The markings are controlled manually or automatically by a controller situated on the truck bed. The epoxy is directed through a series of hoses under pressure and applied to the roadway surface.

Epoxy is durable for many traffic areas and can be applied through a wide range of conditions as it is admixed at point of use. The longevity of epoxy and its ease of application make it very cost effective for many roadway applications. An epoxy mixture can be highly reflective with the addition of retro-reflective glass beads.

Conventional pavement striping trucks typically include large capacity kettles that are vertically disposed. Such kettles can be quite tall and provided with various structures, such as platform steps, ladder rungs, bridges, etc., which enable operators or tenders to access and charge material into the tops of the kettles. Epoxy is transferred as a liquid, and conventional systems require the epoxy to be transferred into the vertically disposed kettles using a pump. The flow rate of the pump depends upon the viscosity of the epoxy; colder temperatures raise the viscosity. In operation, a striper truck may receive a volume of epoxy material the evening before a striping operation is to occur. In this manner, the epoxy materials, resin and catalyst, can be heated during off hours to the optimum temperature. At the point of application, the epoxy materials, resin and catalyst, are mixed. Should the epoxy material be exhausted, refilling of the kettle can be performed in the field by stopping the truck and refilling, or again during the off hours. Refilling of the kettle is time consuming and the transfer rate is dependent upon the viscosity of the epoxy materials. This is typically a slow process that increases both production time and job cost.

Another problem with known striper trucks used to apply epoxy is the use of high pressure pumps for the recirculation of epoxy material. The high pressure pumps are of a considerable expense, and the continued use of the pumps for non-spraying purposes leads to early repair and/or replacement. Still another problem with conventional striper trucks is the need for insulated delivery lines wherein the insulation can hide leaks and presents an added expense.

What is desired is an improvement to striper trucks by use of laterally disposed kettles for use in applying epoxy material to a road surface in a most efficient manner. The laterally disposed kettles provide room for truck mounted totes, essentially doubling the truck range and providing a real time operating system that feeds epoxy materials into kettles at a rate that is suitable to handle the demands of the dispensing system onto the pavement as needed on a continuous basis. Also what is needed is a circulation system that eliminates the need for insulated transfer piping.

SUMMARY OF THE INVENTION

An improvement to surface marking devices for heating and applying epoxy material to roads, parking lots and the like is provided. The surface marking device is comprised of a truck incorporating laterally disposed kettles with internal heat exchangers. In a preferred embodiment, a first kettle holds yellow resin, a second kettle holds a resin catalyst, a third kettle holds white resin, and a fourth kettle holds black resin. Each kettle has an output fluidly coupled to a transfer pump.

Each kettle includes a heat exchanger for receipt of heated glycol that is circulated through a diesel burner or, in the alternative, a heat exchanger coupled to a device that produces waste heat, such as an air compressor used for applying the epoxy material through spray nozzles. By use of a manifold system, material transfer does not need to be insulated.

Placement of the kettles in a lateral position allows an upper side surface of the kettles to receive a platform capable of carrying epoxy material in the form of totes holding liquid resin and catalyst. The platform is constructed and arranged to hold four 275 gallon conventional totes positioned so as to allow gravity drainage from the totes to each respective kettle; each tote having a heating element that can be inserted into the tote for preheating of the material contents. In an embodiment, the heating element is an electric coil. By preheating the material within the totes, the resin and catalyst can be gravity fed, optionally by pump, from the tote to the respective kettle, allowing continuous striper operation. The kettle can be refilled or replaced as needed and, critically, refilled while the truck is moving, allowing for a continuous marking operation. Replacement of the totes may take place without causing equipment downtime.

Accordingly, it is an objective of the present invention to provide a truck for road striping that employs laterally disposed kettles for holding epoxy resins and a catalyst, wherein the truck includes a platform placed above the kettles for holding multiple industrial sized totes.

It is another objective of the present invention to provide a laterally disposed kettle having a glycol heat exchanger extending from a first end to a second end, the glycol heat exchanger having an outer wall to secure against leaks.

Still another objective of the invention is to provide a truck for striping wherein epoxy materials can be preheated in kettles and totes so as to eliminate down time for temperature stabilization.

Yet another objective of the invention is to provide a fluid communication between a tote and a kettle to allow continuous replacement of epoxy material drawn from a kettle by gravity.

Yet another objective of the invention is to provide a relatively short length truck capable of continuous roadway marking and the use of a cover to avoid contamination during liquid transferring.

Still another objective is to eliminate the need for a supply truck, as conventionally required by a striper truck having vertically disposed holding tanks, to accompany the main striper truck.

Another objective is to teach a glycol and epoxy circulation system that eliminates the need for jacketed/insulated transfer lines.

Yet still another objective of the invention is to increase the safety to workers by eliminating the need to work on vertically disposed kettles.

Still another objective of the invention is to provide a system for accurately mixing resin and catalyst, thereby eliminating operator monitoring of duplex gauges.

Yet still another objective of the invention is to teach the use of laterally disposed kettle for storage of glass beads wherein removal of the conventional vertical container allows for additional platform storage wherein totes of glass beads can be maintained.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
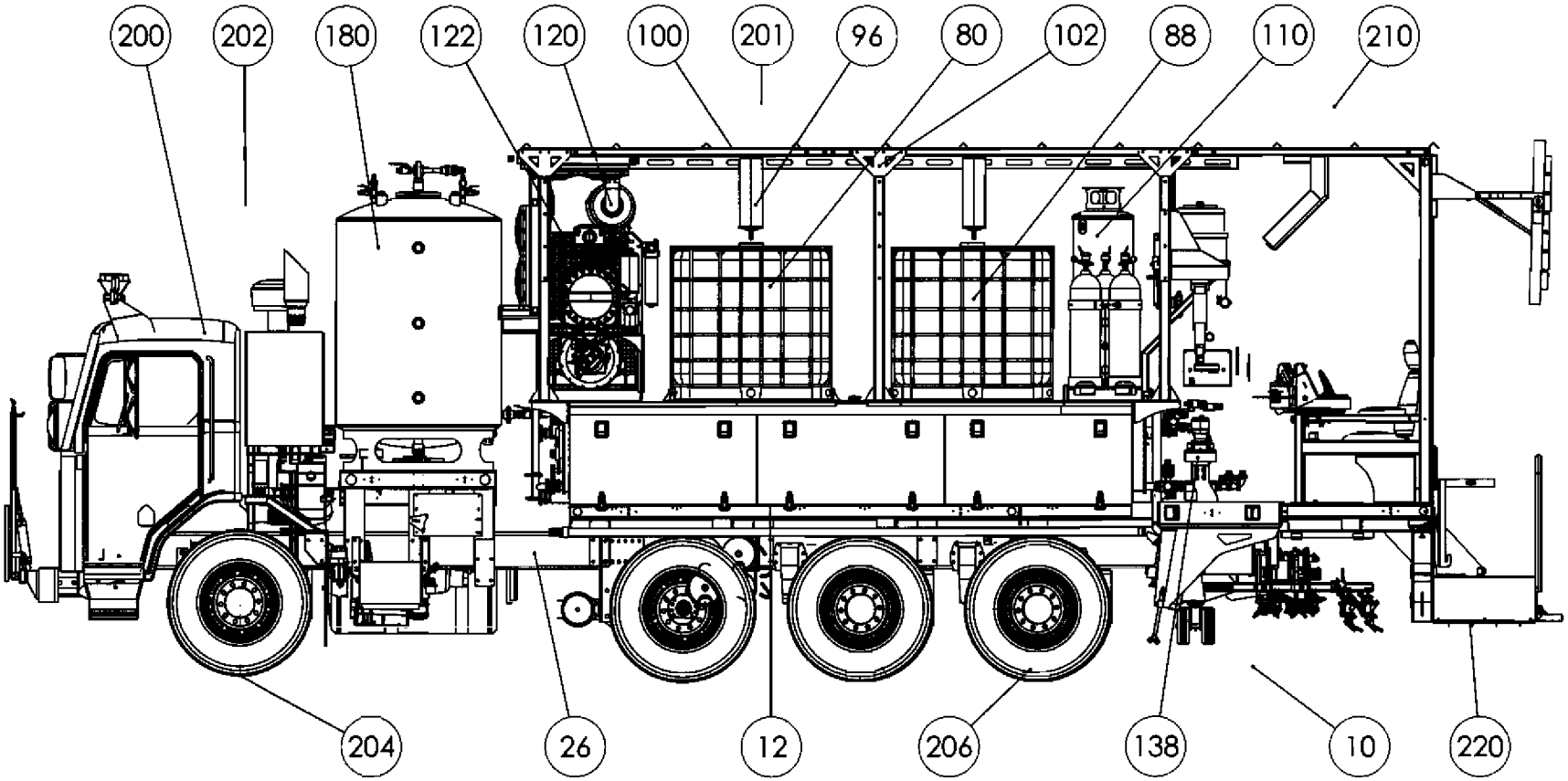
FIG. 1 is a side view of the vehicle of the instant invention.
Figure 2:
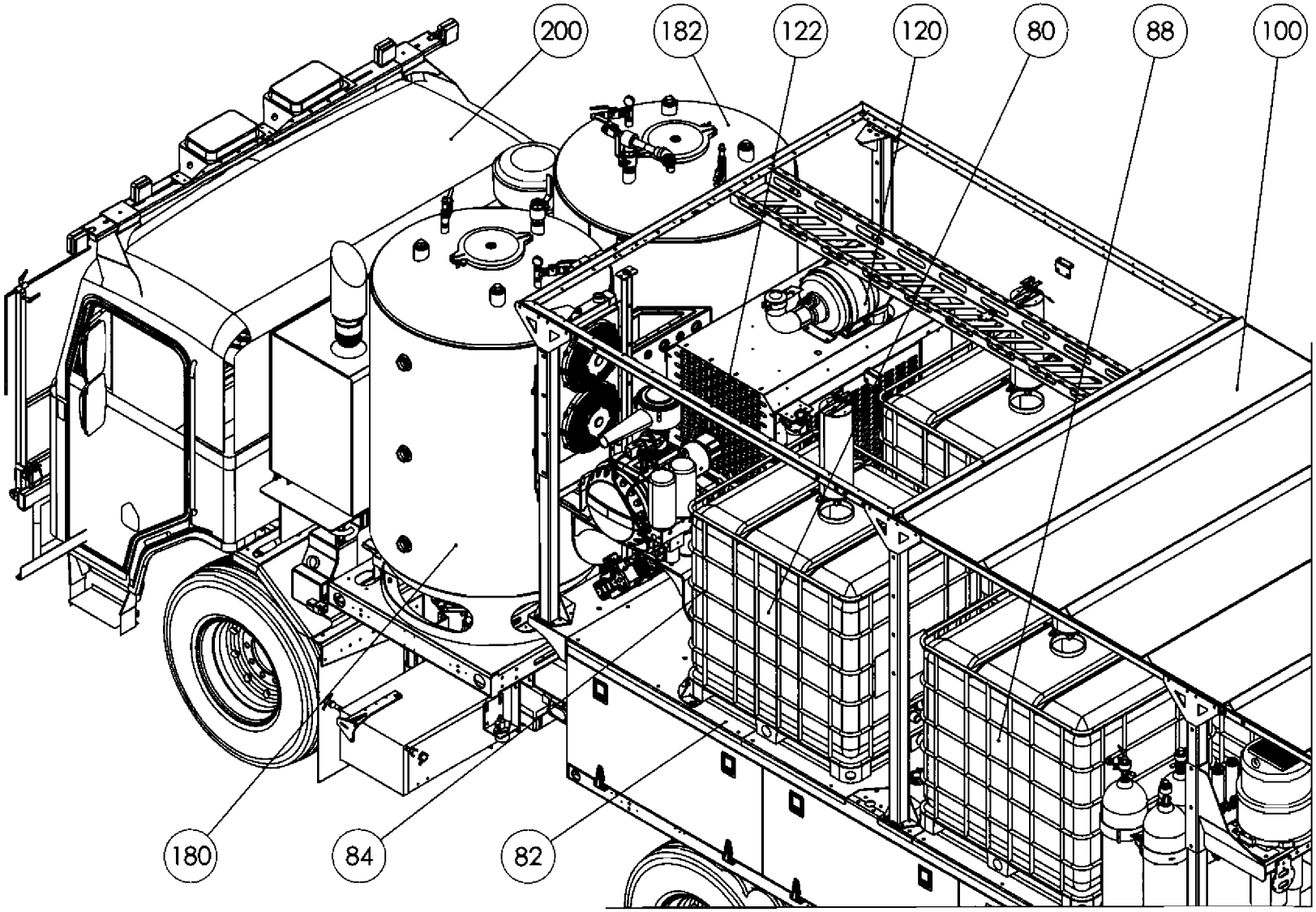
FIG. 2 is a perspective view regarding the front section of the vehicle.
Figure 3:
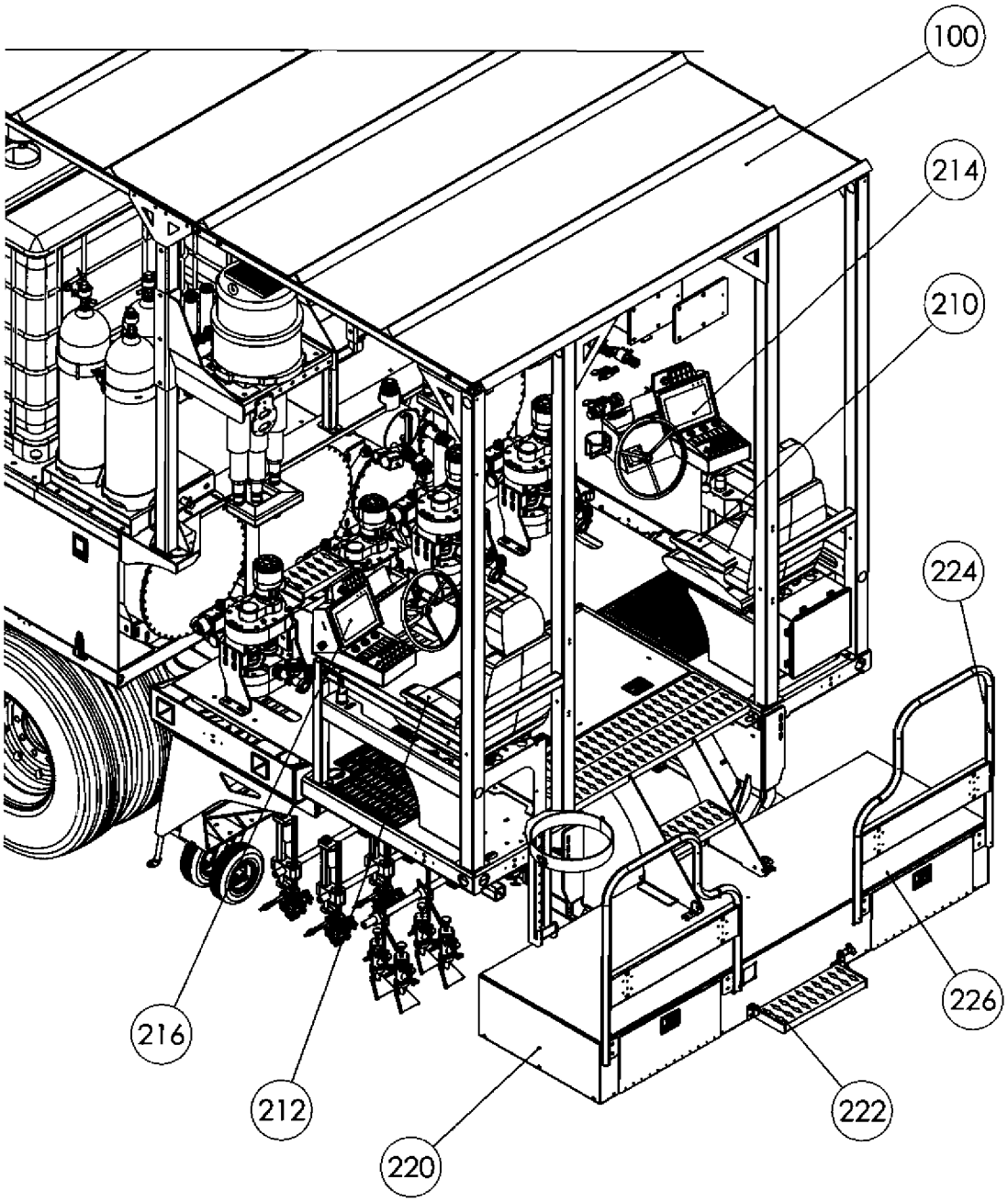
FIG. 3 is a perspective view regarding the rear section of the vehicle.
Figure 4:
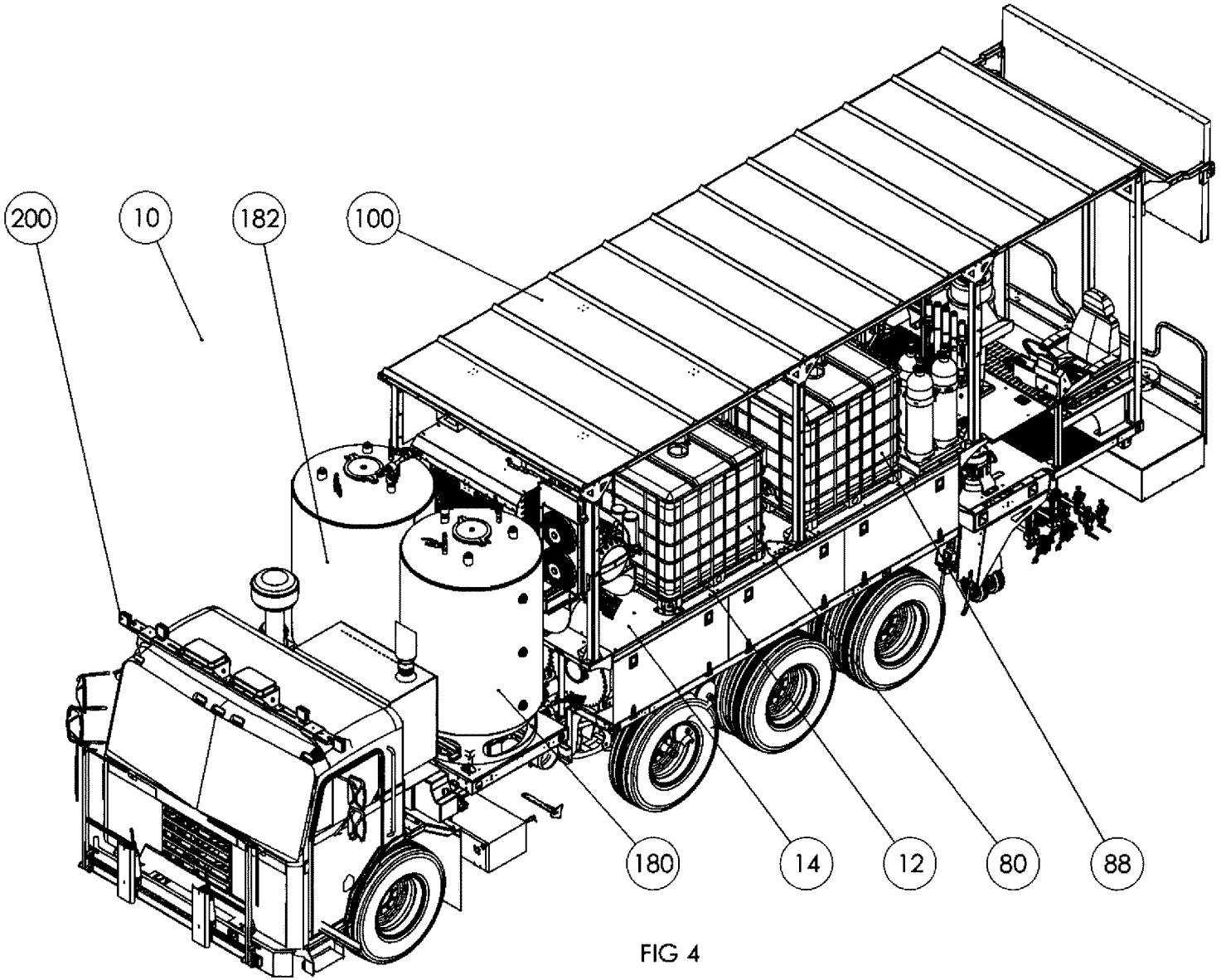
FIG. 4 is an upper pictorial perspective view thereof.
Figure 5:
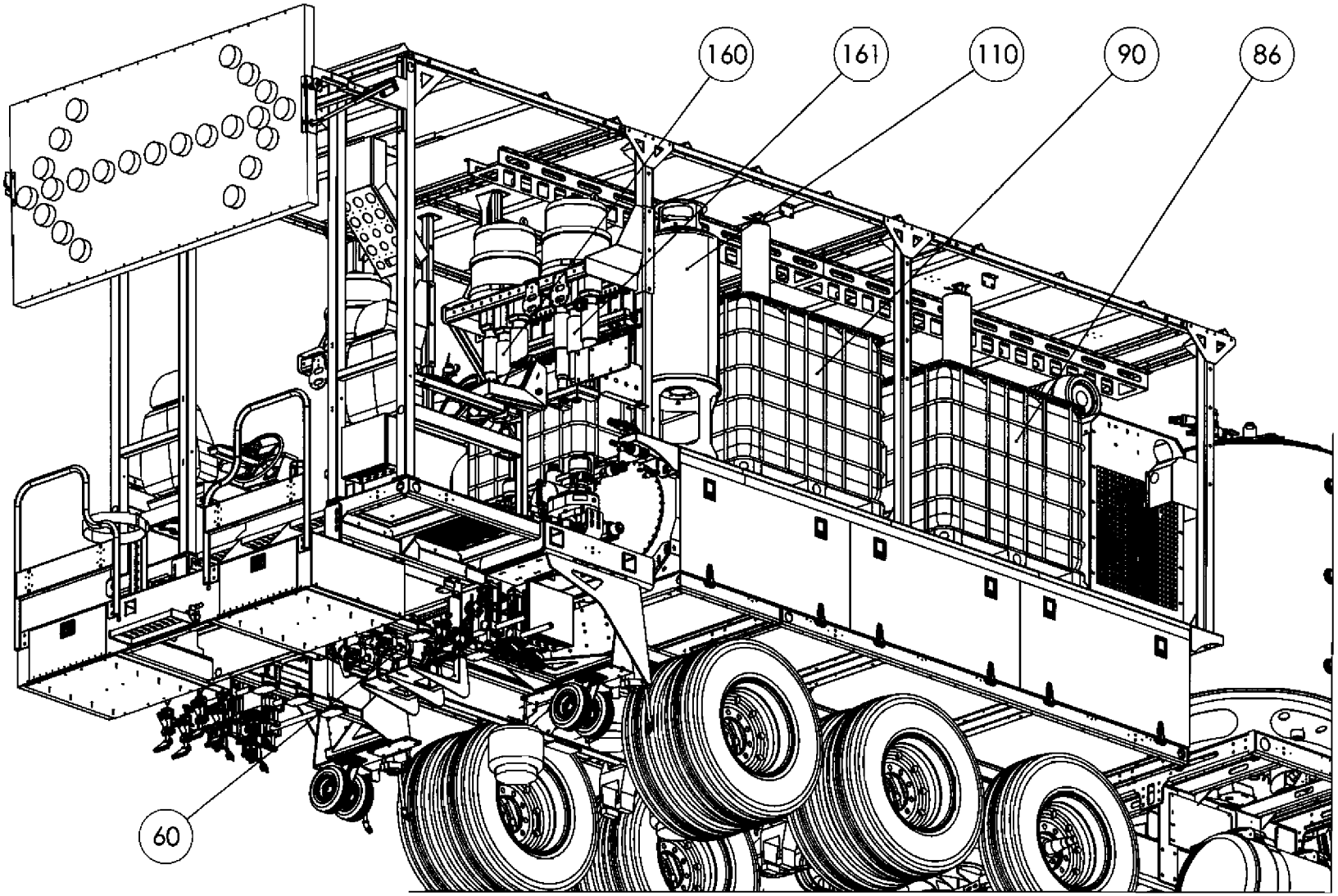
FIG. 5 is a lower pictorial perspective view thereof.
Figure 6:
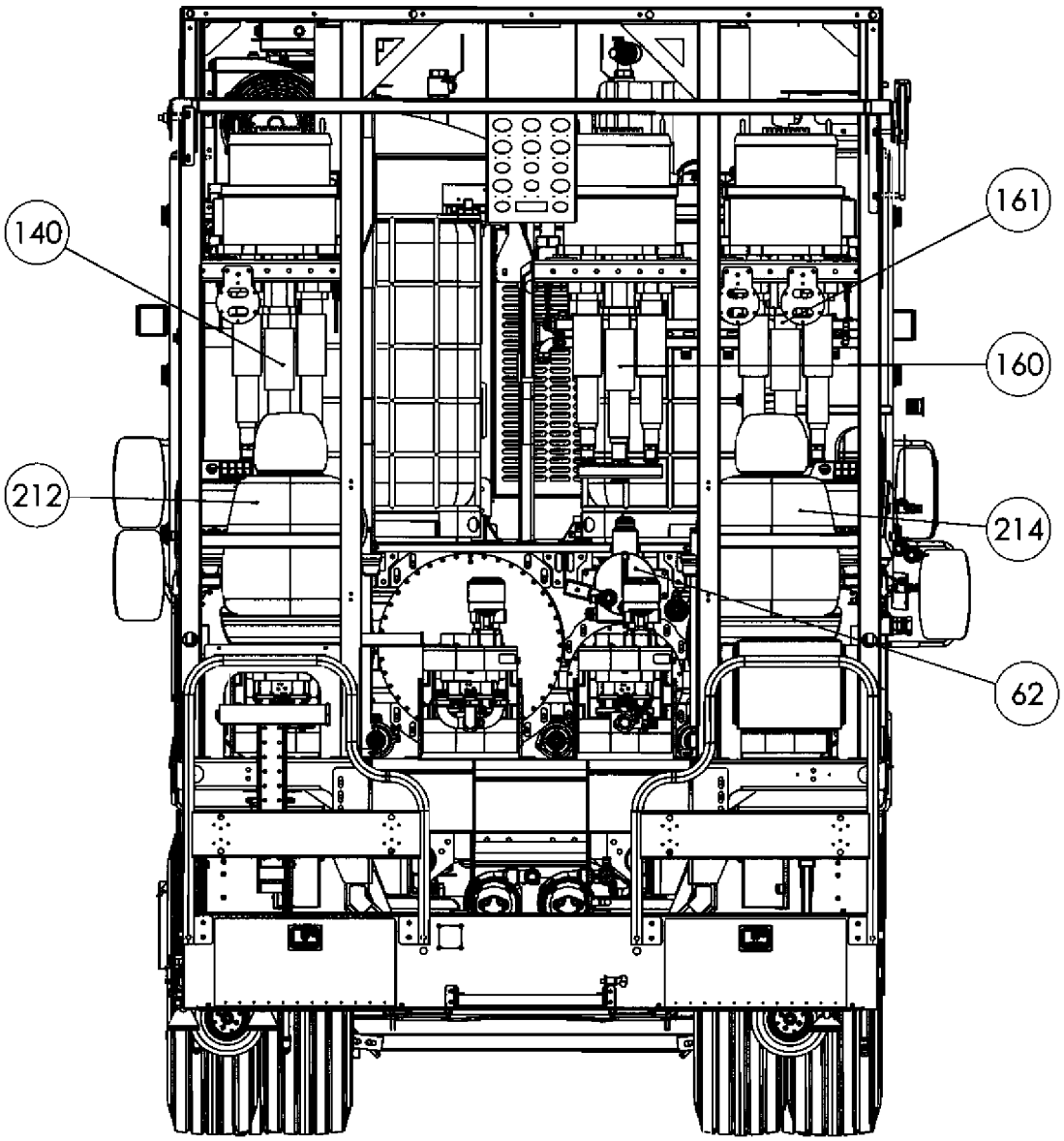
FIG. 6 is a rear view thereof.
Figure 7:
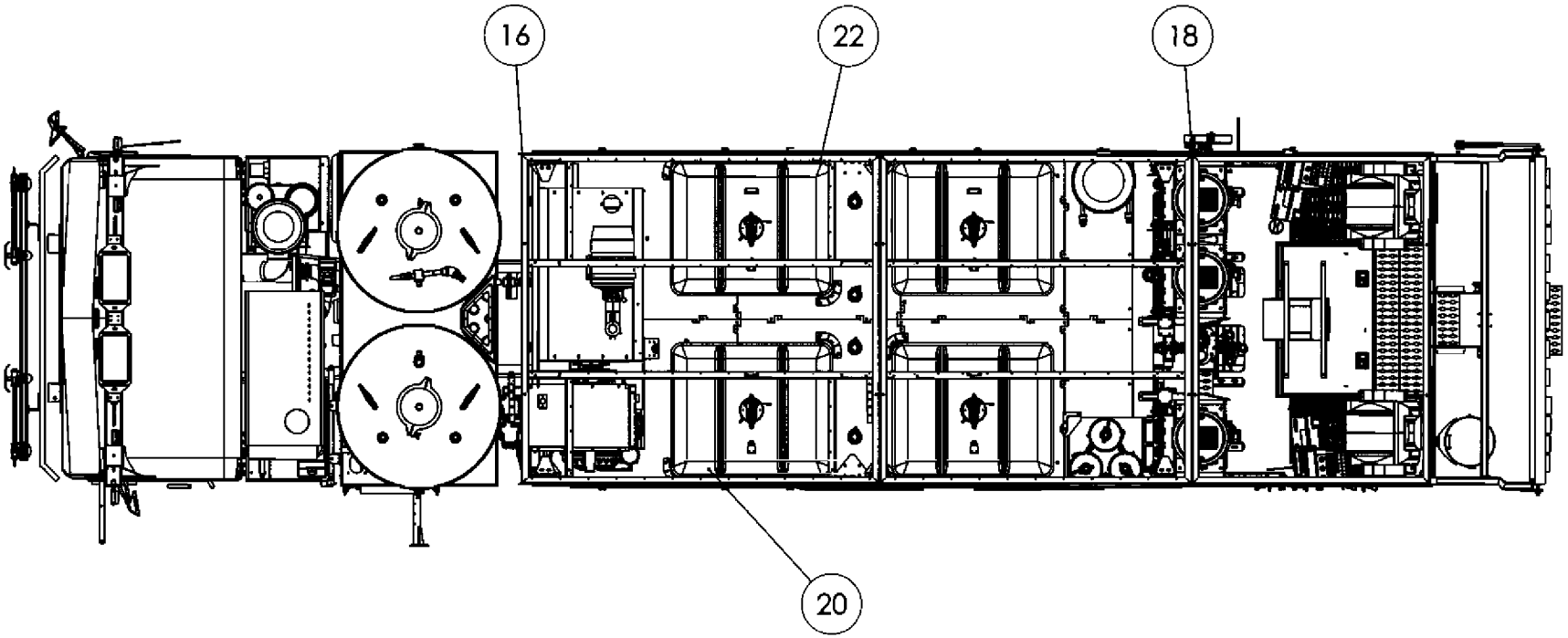
FIG. 7 is a top view thereof.
Figure 8:
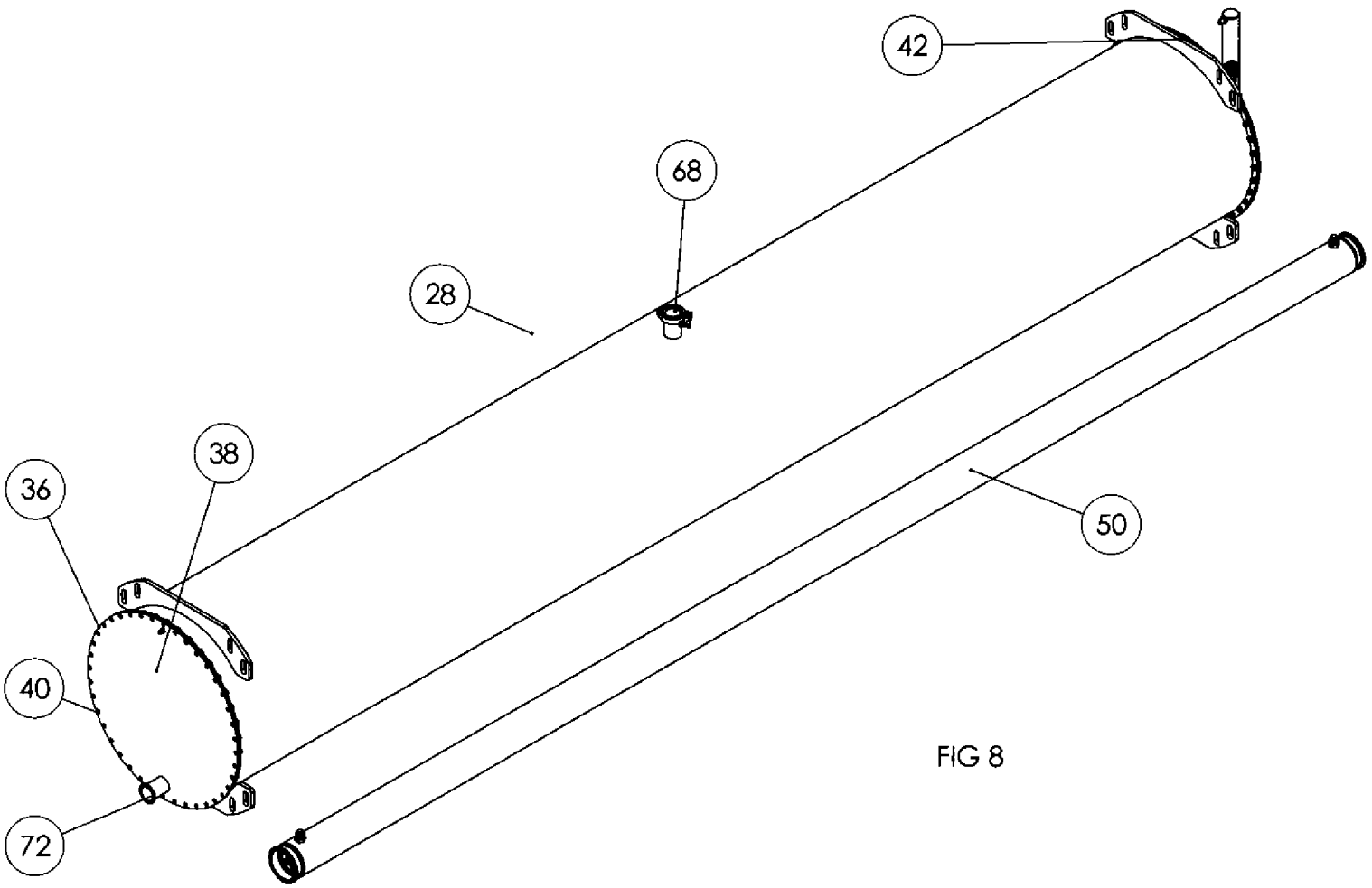
FIG. 8 is a perspective view of a kettle.
Figure 9C:
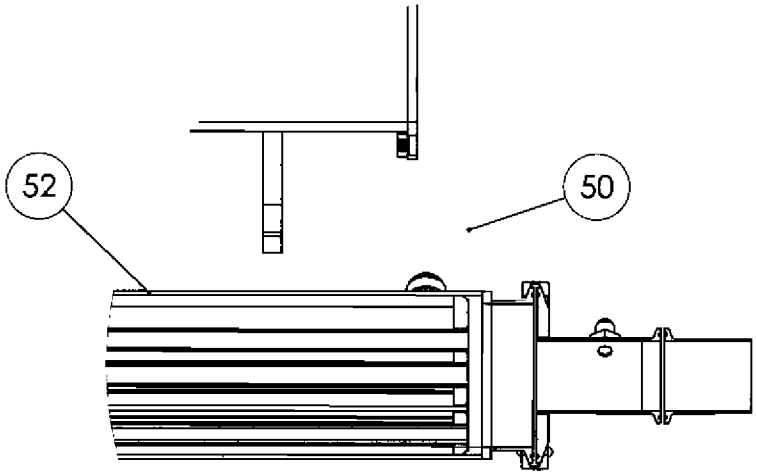
FIG. 9C is a cross-sectional view taken along lines B-B of FIG. 9B.
Figure 9A:
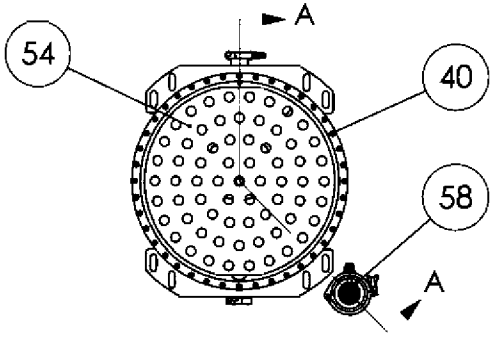
FIG. 9A is an end view of a kettle.
Figure 9B:
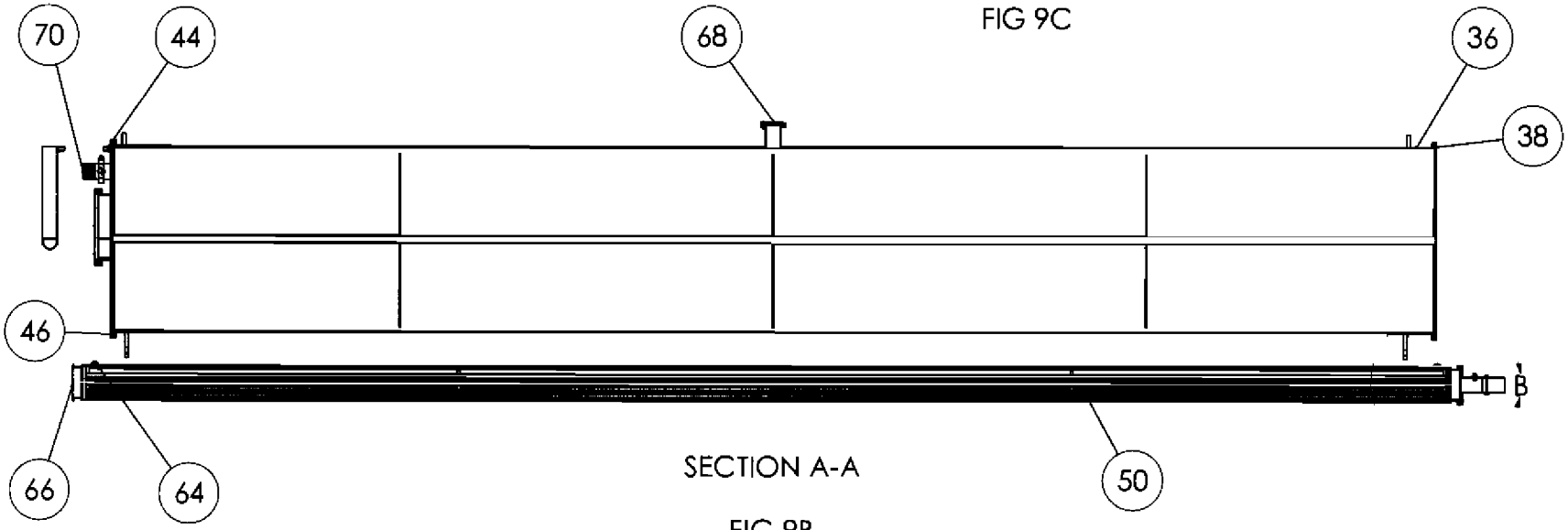
FIG. 9B is a cross-sectional view taken along lines A-A of FIG. 9A.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Now referring to the figures, a self-propelling pavement striping truck 10 for applying epoxy material to a road surface is illustrated. The pavement striping truck 10 is comprised of a platform 12 having an upper surface 14 having a front edge 16, a rear edge 18, a left edge 20 and a right edge 22. Beneath the platform 12 and positioned on the truck chassis 26 is a first laterally disposed kettle 28, a second laterally disposed kettle 30, a third laterally disposed kettle 32, and a fourth laterally disposed kettle 34. The first three kettles 28, 30, 32 hold about 300 gallons each and extend the length of the platform 12, from the front edge 16 to the rear edge 18. The kettles are used to hold colored resins and a resin catalyst, the exact arrangement of colored resin placed in the kettles is not necessary for this invention. A fourth kettle 34 is approximately one half the length of the first three kettles, about 150 gallons, to hold black resin, which is commonly used to highlight the yellow and white epoxy stripes.

Depicted in FIGS. 8, 9A-9C is a kettle 28 which is identical to the kettles 30 and 32, and representative of kettle 34 which is approximately one half the length of the first kettle 28. Kettle 28 has a first end 36 having a first cap 38 secured by fasteners 40 thereto. Removal of the first cap 38 allows ease of service. Kettle 28 has a second end 42 with a second cap 44 secured by fasteners 46 thereto. Removal of the second cap 44 allows cleaning of the kettle if needed.

A heat exchanger 50 is formed from an outer tube 52 extending from said first cap 38 to said second cap 44. A plurality of inner tubes 54 within the outer tube 52 are fluidly coupled to a collector 56 and a fluid fitting 58 to allow transfer of ethylene glycol or the like heated admixture from a recirculation pump 60 fluidly coupled to a glycol storage tank 62 using a hose. For ease of drawing clarity, the inner-connecting hoses are not depicted. A further collector 64 is located at the opposite end of the kettle 28 with a fluid fitting 66 allowing closed loop circulation of the glycol. In a preferred embodiment, the kettle 28 is positioned at an angle allowing gravity flow from the first end 36 toward the second end 42. The heat exchanger 50 is positioned at about a 4 o'clock position, allowing epoxy resin to drain off the element 50. The kettle 28 may be filled through a top mounted inlet 68 located at the first end 36 or a second end 42 positioned inlet 70.

One or both inlets 68, 70 are fluidly coupled to a tote 80. The tote 80 is a conventional 275 gallon polyethylene container mounted on a skid 82 having forklift openings for ease of replacement. A steel cage 84 reinforces the polyethylene container, with the tote 80 having a convention 2" drain opening that is releasably coupled to the kettle. The tote 80 includes a heating element 96 defined as a coil used in circulating heated glycol to warm the material before introducing into the kettle 28. If warmed to the preferred application temperature, namely 140° F., the epoxy material can flow to the kettle on a continuous basis, allowing the striping operation to continue without interruption. When the totes 80, 86, 88, 90 have been emptied, the totes can be replaced and the heating mechanism engaged to heat the epoxy material to the proper temperature before flowing to the kettles. For ease of understanding, tote 80 is detailed with the remaining totes being duplicate thereto. The platform 12 is sized to receive four totes 80, 86, 88, and 90. Each tote is releaseably coupled to a kettle. Tote 80 can hold white resin, tote 86 can hold yellow resin, tote 88 can hold black resin, tote 90 can hold resin catalyst, or any variation thereto; each kettle being duplicate in design, except for the black resin kettle 88 which can be shorter in length.

In one embodiment the glycol is passed through a diesel fueled burner 110 and directed to the heat exchanger 50 for each kettle and a heating mechanism 92 introduced into the other totes as heating mechanisms 94, 96, 98 and 99. The heating mechanisms are secured to a cover 100 having a frame 102 attached to the platform 12. The heating mechanisms can be inserted into the top of each tote when heating of the epoxy material is desired. In one embodiment, the heating mechanisms 94, 96, 98 and 99 are made of electric coil. The cover 100 protects from rain and sun to allow draining of totes and/or kettles when the truck is not in service. In a preferred embodiment, each kettle is set at an angle, providing about a 1-inch differential from the front edge 16 to the rear edge 18. In an alternate embodiment, the front end 36 of the kettle may have a differential of up to 10 degrees from the rear end 42 of the kettle.

The burner 110 is used to regulate the heat of the epoxy material to a preferred temperature of 140° F., with a range between 130° F. and 145° F.; the burner 110 having a plurality of coils carrying the glycol that is heated with the diesel fueled flame. An ethylene glycol storage tank 62 is positioned beneath the platform 12 and placed in line with the shorter kettle used for black resin. The glycol recirculation pump 60 is further positioned adjacent to the storage tank 62 and used for circulating the heated glycol. While ethylene glycol provides excellent heat transfer, other admixtures can be used and considered to be within the scope of this invention.

In an alternative embodiment, especially for use in temperate climate, glycol can be passed through a radiator type heat exchanger 122 coupled to a high pressure air compressor 120. The air compressor 120 works in combination with a hydraulic driven pump apparatus 130 for mixing and spraying of the epoxy material. Still another embodiment is to employ electric heater elements for heating of the epoxy materials.

In another embodiment, a laterally disposed kettle may also be employed for storage of glass beads. The removal of the conventional vertical storage container allows for additional platform space wherein totes of glass beads can be maintained similar to the epoxy materials.

Figure 10:
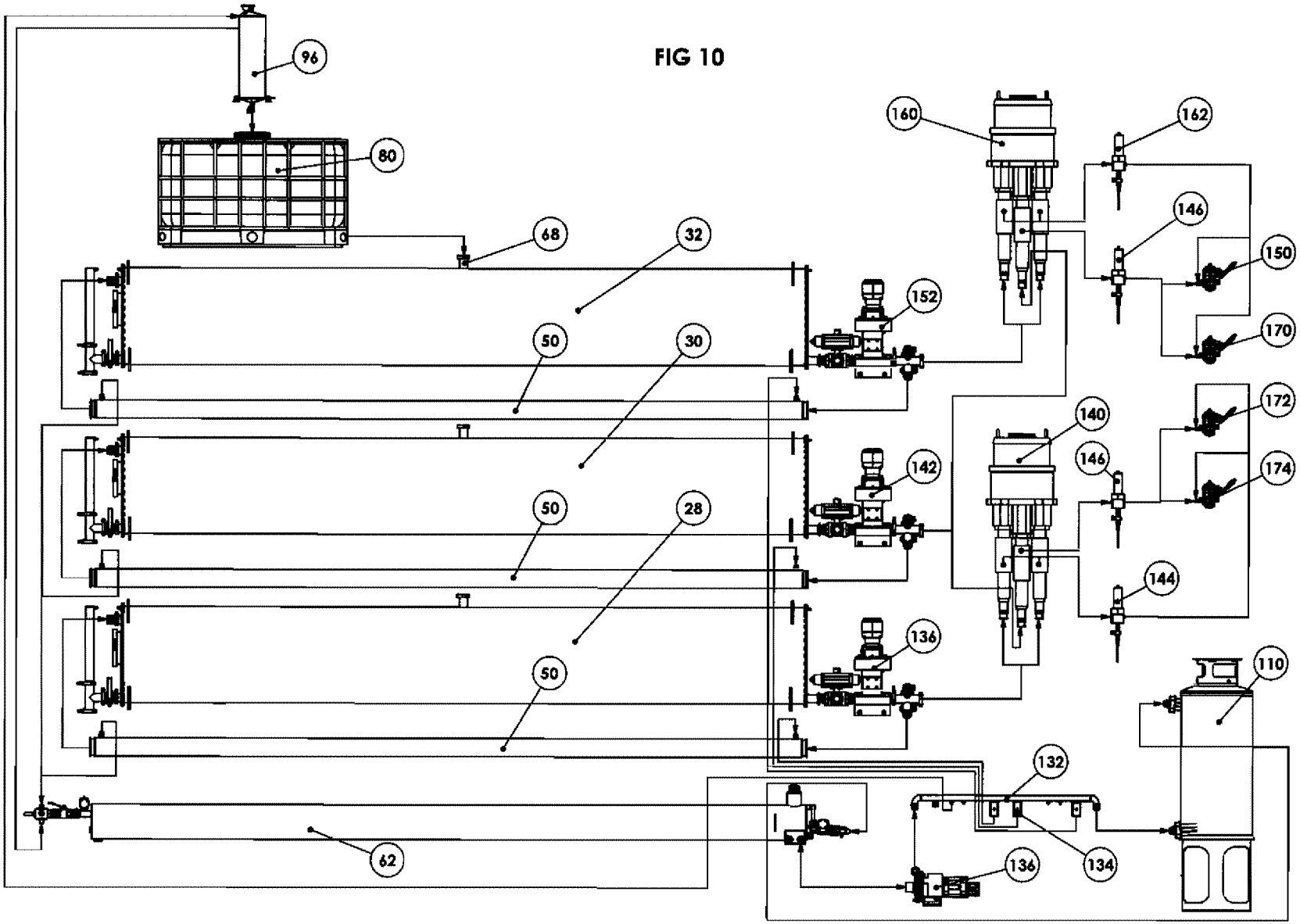
FIG. 10 is a flow diagram of the epoxy hydraulic system.

Referring to the flow diagram in FIG. 10, disclosed is an application system that eliminates the need to insulate piping. In operation, a glycol recirculation pump 60 directs heated fluid to a manifold 132 with outputs each having a temperature controlled motorized ball valve 134. A recirculation line is provided from the manifold 132 to the burner 110 and glycol storage tank 62. The heated fluid is directed to the heat exchanger 50 located in each of the individual kettles 28, 30, 32, 34. After passing through the kettles, the glycol is collected in a return manifold 136 for return to the glycol storage tank 62.

Epoxy material is drawn from a first kettle 28 by use of a first hot pump 138 into a high pressure material transfer pump 140, such as those manufactured by Wiwa. The epoxy catalyst is drawn from a kettle 30 by a second hot pump 142 and directed to the high pressure material transfer pump 140. The white epoxy is drawn through a high pressure filter 144 to a first spray dispensing device 150, and the catalyst is drawn through a second high pressure filter 146 to the first spray dispensing device 150. If the spray dispensing device is open, the white epoxy resin and the catalyst admix. If the spray dispensing device is closed, the white epoxy resin and catalyst are circulated back to their respective kettles. In the preferred embodiment, the hot pump capable of pressurizing the epoxy material to 300 psi and the high pressure Wiwa pump increase pressures up to ten times, wherein the system has a preferred embodiment up to 3000 psi.

The yellow epoxy resin is drawn from a kettle 34 by a third hot pump 152 and directed to the high pressure material transfer pump 160. Simultaneously, the epoxy catalyst is transferred by the second hot pump 142 and directed to the high pressure material transfer pump 160. The yellow epoxy resin is drawn through a high pressure filter 162 to a second fusion spray dispensing device 170, and the catalyst is drawn through a high pressure filter 164 to the second spray dispensing device 170. If the spray dispensing device is open, the yellow epoxy resin and the catalyst admix. If the spray dispensing device is closed, the yellow epoxy resin and catalyst are circulated back to their respective kettles. A second spray dispensing device 172 can be used for applying white epoxy with glass beads; similarly, a third spray dispensing device 174 can be used for applying yellow epoxy with glass beads. The holding tanks 180 and 182 provide storage for additives, namely retro-reflective glass beads. Retro-reflective materials reflect light directly back to the source through micro prisms or glass beads.

There are various devices that may be attached to the spray dispensing device 170, 172, 174 to apply epoxy onto the pavement surface such as, but not limited to, a ribbon dispenser, spray dispensing device, screed extrusion device, or the like, not shown. The spray dispensing device results in a spray pattern that is a uniformly thick and well-defined stripe.

The pavement striping truck 10 consists of a cab 200 having a drive motor 202 mounted over a chassis 26, steering wheels 204 beneath the cab 200, load wheels 206 beneath the chassis 26, and a bed portion 201 extending for a length behind the cab 200. A dual operator station 210 includes a pilot section 212 having a control panel 216 for operational display of all components. A co-pilot section 214 allows for steering of the vehicle. A carriage 220 positioned behind the operator station 210 provides a step 222 and grab rails 224 for ease of access. Bins 226 provide an area for waste collection, in particular, gun start up leaves a splatter that can be easily accessed by use of the carriage, wherein an operator can immediately address the splatter.

Figure 11:
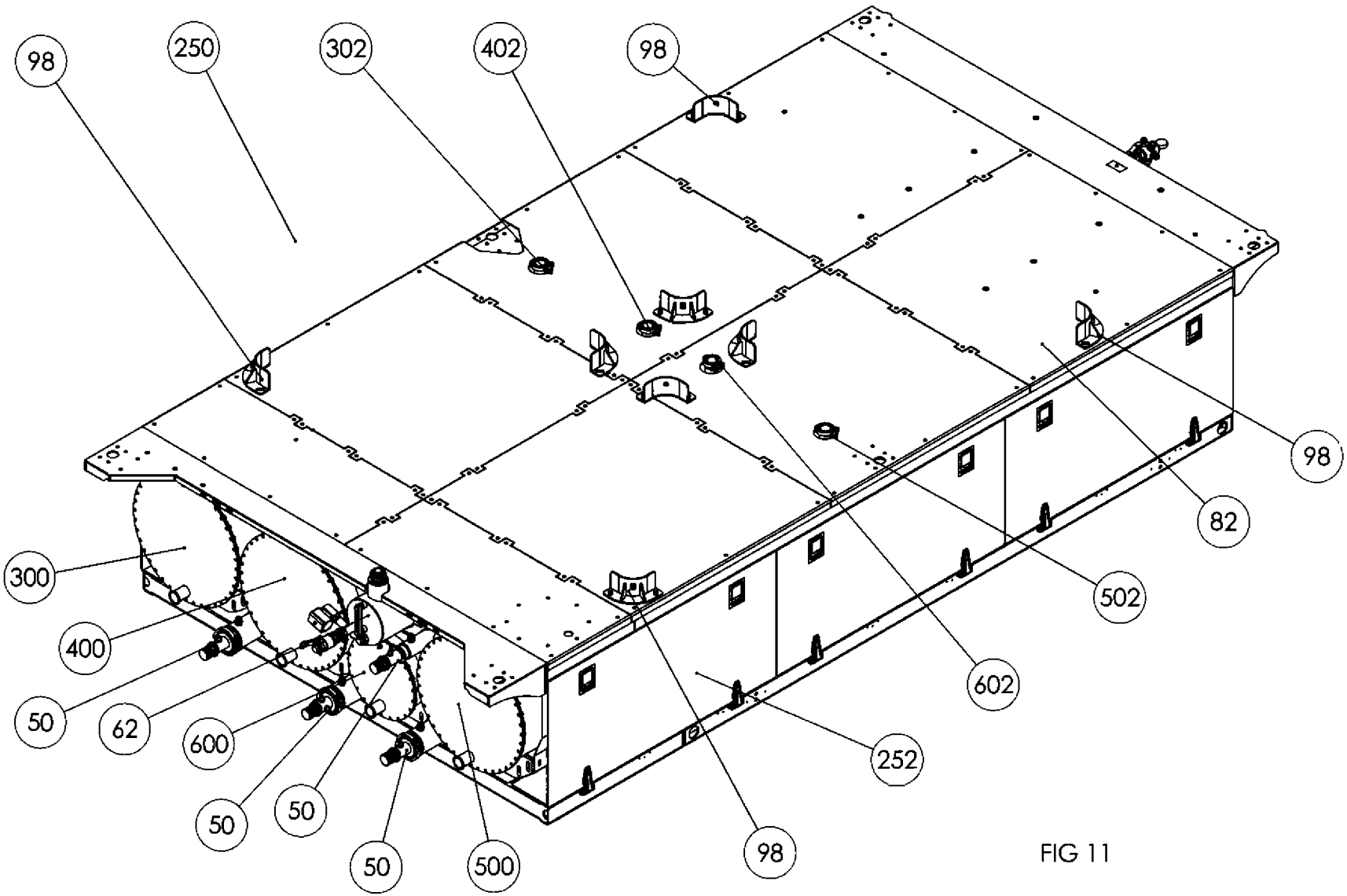
FIG. 11 is a perspective view of an embodiment depicting four laterally disposed kettles enclosed in a casing.
Figure 12:
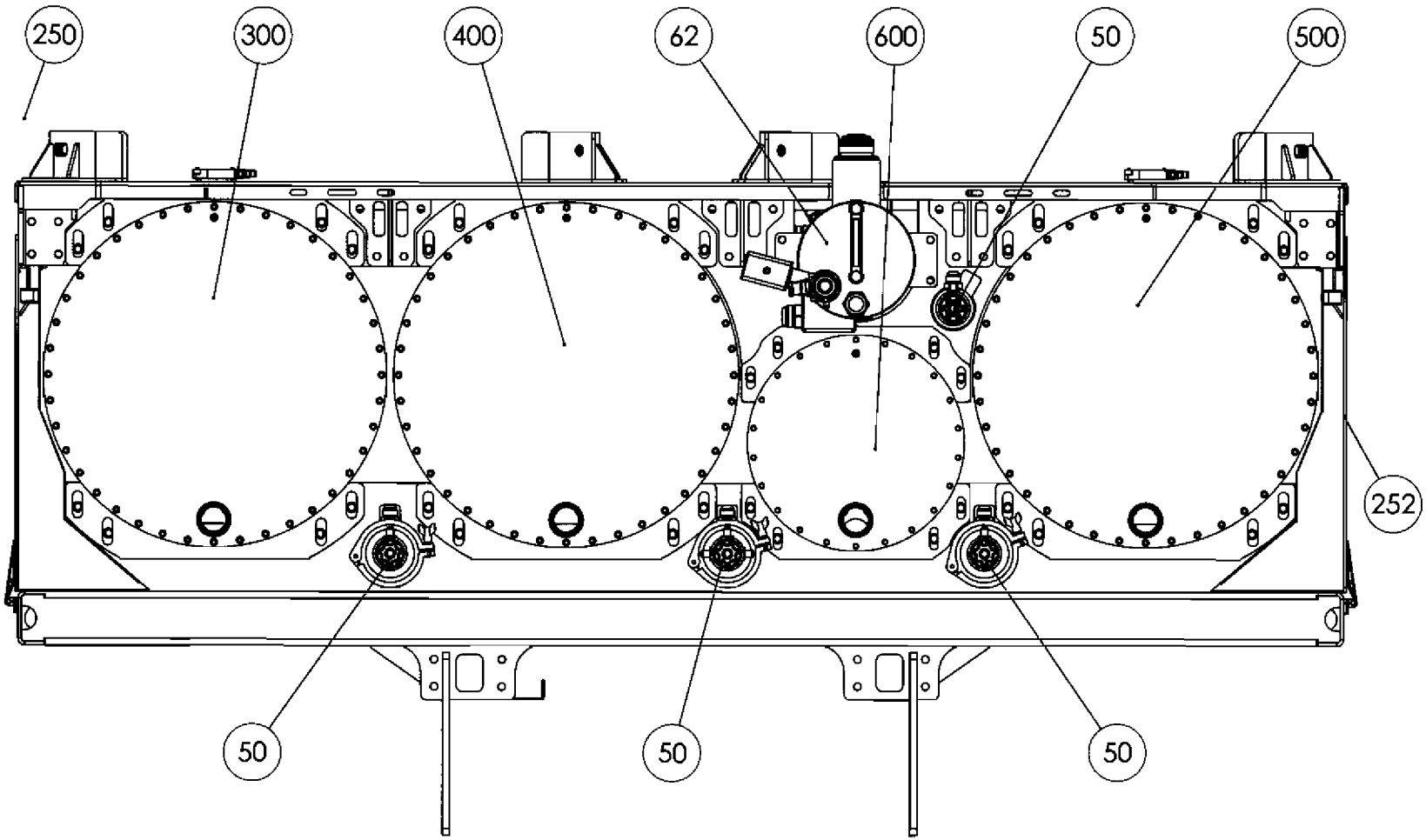
FIG. 12 is a front view thereof.

Referring now to FIG. 11, a laterally disposed kettle encasing 250 is shown. The top of the encasing 250 is designed to support totes 80, 86, 88, 90 along the skid 82 and are fitted against tote mounts 98. In the disclosed embodiment, the encasing 250 contains four laterally disposed kettles. In a preferred embodiment, the encasing 250 contains a yellow epoxy laterally disposed kettle 300 disposed next to a catalyst laterally disposed kettle 400 disposed next to an optional and smaller black epoxy laterally disposed kettle 600 disposed next to a white epoxy laterally disposed kettle 500. Each laterally disposed kettle is associated with an external heat exchanger 50 that is positioned parallel to the laterally disposed kettle. The glycol storage tank 62 is fitted within the laterally disposed kettle encasing 250, preferably above the smaller black epoxy laterally disposed kettle 600.

Each tote 80, 86, 88, 90 can be either gravity fed or connected via hoses and pumped to a top mounted inlet 302, 402, 502, 602 on each laterally disposed kettle. For example, the tote 80 may contain heated white epoxy material that is gravity fed into the white epoxy kettle top mounted inlet 502, the tote 86 may contain heated yellow epoxy material that is gravity fed into the yellow epoxy kettle top mounted inlet 302, the tote 88 may contain heated black epoxy material that is gravity fed into the black epoxy kettle top mounted inlet 602, and the tote 90 may contain heated catalyst material that is gravity fed into the catalyst kettle top mounted inlet 402. Additionally, storage for loading hoses is contained behind a series of side doors 252 located on the side of the encasing 250.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The term "about" means, in general, the stated value plus or minus 5%. The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A mobile truck apparatus for applying epoxy to road surfaces, said apparatus comprising:

a mobile truck having a frame forming an integral part of the mobile truck, said mobile truck is self-propelled with said frame supporting a cab portion at a front of said frame and a bed portion extending for a length behind said cab portion;

a first kettle laterally positioned and extending along a length of said frame for receipt of a first epoxy material;

a first heat exchanger operatively associated with said first kettle and positioned along the length of said frame in a position parallel to said first kettle;

a second kettle laterally positioned and extending along the length of said frame for receipt of a catalyst material;

a second heat exchanger operatively associated with said second kettle and positioned along the length of said frame in a position parallel to said second kettle;

a third kettle laterally positioned and extending along the length of said frame for receipt of a second epoxy material;

a third heat exchanger operatively associated with said third kettle and positioned along the length of said frame in a position parallel to said third kettle;

a platform positioned above said first, second and third kettles and said first, second and third heat exchangers;

a plurality of totes removably attached to said platform, each of said plurality of totes fluidly coupled to at least one of said first, second and third kettles;

a heating mechanism insertable into each of said plurality of totes;

a burner secured to said platform, said burner directing a heated fluid through said first, second and third heat exchangers for heating said first, second and third kettles;

a spraying system operatively associated with each of said first, second and third kettles for mixing said first or second epoxy material with said catalyst material for application to a road surface, a recirculation system for each of said first and second epoxy materials and said catalyst material employing unjacketed transfer lines between said first, second and third kettles and said spraying system.

2. The truck apparatus according to claim 1 wherein each of said plurality of totes holds about 275 gallons of material.

3. The truck apparatus according to claim 1 wherein said heating mechanism is a coil for circulating glycol, said glycol heated with said burner, said glycol circulated through a laterally disposed storage tank.

4. The truck apparatus according to claim 1 wherein said heating mechanism is is an electric coil.

5. The truck apparatus according to claim 1 wherein each of said first, second and third heat exchangers is constructed and arranged to maintain epoxy material in a kettle to temperature of about 140° F.

6. The truck apparatus according to claim 5 wherein each of said first, second and third heat exhangers is further defined as a plurality of fluid transfer tubes positioned within an enclosure tube, said fluid transfer tubes for receipt of glycol heated with a burner operated on diesel fuel, said glycol circulated through a laterally disposed storage tank.

7. The truck apparatus according to claim 5 wherein each of said first, second and third heat exchangers is further defined as a plurality of fluid transfer tubes positioned within an enclosure tube, said fluid transfer tubes for receipt of glycol heated from a fluid heat exchanger coupled to an air compressor wherein waste heat from said air compressor is directed through said fluid heat exchanger.

8. The truck apparatus according to claim 1 including a holding tank for retro-reflective glass beads, said glass beads added to the spraying system upon epoxy application.

* * * * *